United States Patent [19]

Miska

[11] 4,352,845

[45] Oct. 5, 1982

[54] PILE WEATHER STRIP WITH BARRIER FIBERS AND BODY FIBERS

[75] Inventor: Stanley R. Miska, Henrietta, N.Y.

[73] Assignee: Schlegel Corporation, Rochester, N.Y.

[21] Appl. No.: 307,887

[22] Filed: Oct. 2, 1981

Related U.S. Application Data

[63] Continuation of Ser. No. 191,927, Sep. 29, 1980, abandoned.

[51] Int. Cl.[3] ..... D04H 11/00

[52] U.S. Cl. ..... 428/88; 49/475; 49/489; 156/72; 428/89; 428/92

[58] Field of Search ..... 428/88, 89, 92; 156/72; 49/475, 489

[56] References Cited

U.S. PATENT DOCUMENTS

| | | | |
|---|---|---|---|
| 3,836,421 | 9/1974 | Terry | 428/88 |
| 4,164,599 | 8/1979 | Kessler | 156/72 |

*Primary Examiner*—Marion McCamish

*Attorney, Agent, or Firm*—Cumpston & Shaw

[57] ABSTRACT

An improved pile weather strip having one or more rows of pile formed from substantially identical, closely packed monofilament yarns of non-circular cross-section whereby improved resistance to infiltration of foreign material such as air and moisture is achieved. Each monofilament yarn fiber is preferably of an enlarged X-shaped cross-section.

8 Claims, 7 Drawing Figures

PILE WEATHER STRIP WITH BARRIER FIBERS AND BODY FIBERS

This application is a continuation of application Ser. No. 191,927, filed Sept. 29, 1980, now abandoned.

BACKGROUND OF THE INVENTION

1. Field of the Invention

The present invention relates generally to pile weather stripping. More particularly, it relates to an improved pile weather strip having a row of pile formed from closely packed monofilament yarns of non-circular solid or hollow cross-section whereby improved resistance to infiltration of foreign material such as air and moisture is achieved.

2. Description of the Priot Art

U.S. Pat. No. 3,836,421 discloses a pile weather strip having a center row of pile formed from yarn fibers of lower denier and greater density than the yarn fibers in the two adjacent rows of pile.

U.S. Pat. No. 3,944,693 shows a pile weather strip having a single row of interspersed first and second pluralities of yarn fibers. The first plurality of fibers have a common first diameter, and the second plurality of fibers have a common second diameter less than the first diameter. The second plurality of fibers are distributed throughout the spaces between the first plurality of fibers for increasing the pile density.

U.S. Pat. No. 4,164,599 discloses a weather strip having a center row of pile in which the yarn fibers may be of any suitable physical shape, texture, length and density. Included in desired physical shapes are flat or twisted fibers as well as flat or essentially circular monofilaments. The center fibers are bonded together to form a windbreak.

A well known form of commercially available pile weather stripping comprises a row of upstanding pile material supported on a flexible backing strip wherein the pile is formed of non-circular shaped yarn fibers.

The primary purpose of a pile weather strip is to seal the space between two relatively movable closure members. Although the known pile weather strips achieve this purpose to a large degree, a major problem is that some air and moisture still passes through the pile. The object of this invention is to provide an improved pile weather strip in which a row of pile therein is formed from substantially identical yarn monofilaments of non-circular cross-section to further reduce the infiltration of air and moisture through the pile.

SUMMARY OF THE INVENTION

In accordance with a preferred embodiment of this invention, an improved pile weather strip having one or more rows of pile formed from substantially identical perferably closely packed monofilament yarns of non-circular cross-section is disclosed for increasing the resistance of the weather strip to air and moisture infiltration. Preferably each monofilament yarn is of an X-shaped cross-section which may be solid or hollow.

The aforementioned invention is believed to increase the resistance of the weather strip to air and moisture infiltration by, among other things, providing nestable monofilament yarns of identical cross-section for decreasing the space between individual monofilaments. This in combination with the smaller multifilament pile fibers interposed between the monofilament yarns increases the sealing ability of the weather strip. Since the increased sealing ability is achieved in this weather strip without the use of a barrier fin, the break-away force required to overcome the sliding resistance of the pile in order to open a sliding member such as a door or window is also reduced. The break-away force is the force required to overcome the inertia or resistance of the door or window when starting to open it from a fully closed position. In those weather strips where a barrier fin is used, the fin tends to snap over or reverse itself as the sliding door or window is moved from a fully closed position, thereby increasing the resistance to such movement to the point that the break-away force required to open a door or window has become excessive. This problem of excessive break-away force or sliding friction is overcome by the improved weather strip of this invention since no barrier fin is used or required.

The invention and its advantages will become more apparent from the detailed description of the invention presented below.

BRIEF DESCRIPTION OF THE DRAWINGS

The details of the invention will be described in connection with the accompanying drawings, in which.

DETAILED DESCRIPTION OF THE INVENTION

Figure 1:
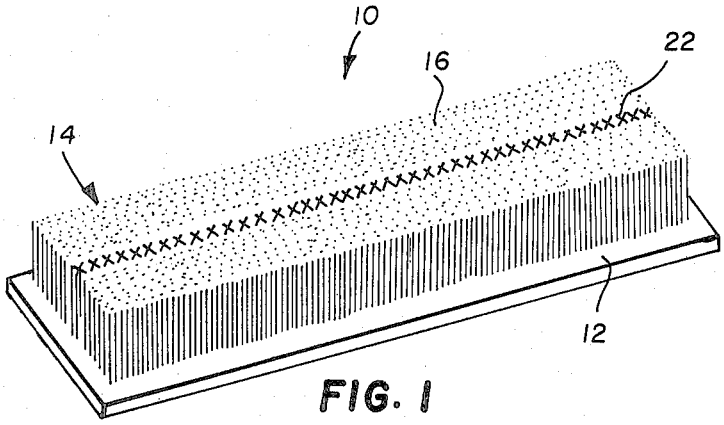
FIG. 1 is a perspective view of a pile weather strip in which a preferred embodiment of a barrier row of monofilament yarns of X-shaped cross-section of the invention is embodied.

Referring to FIG. 1 of the drawing, an improved pile weather strip 10 of this invention is disclosed comprising a backing or base strip 12 which in one of its forms is woven of textile fibers, either natural or synthetic, as is well known in the art.

Figure 3:
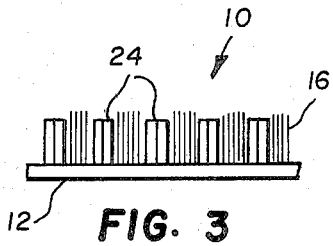
FIG. 3 is a side elevational view of the weather strip of FIG. 2.
Figure 5:
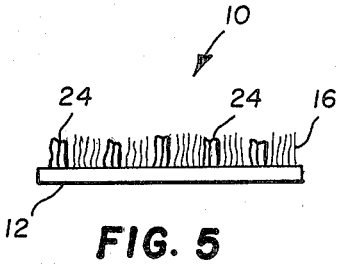
FIG. 5 is a side elevational view of the weather strip of FIG. 4.

A pile 14 formed from a body of upstanding flexible and resilient yarn fibers 16 of known type as best seen in FIG. 3 is fixed to backing strip 12 by mechanical embedments, flocking, tufting, weaving or other known methods. Yarn fibers 16 are produced from any one of several polymeric or synthetic base materials such as polypropylene, nylon, polyester, acrylic, orlon or the like. Each yarn fiber 16 is a multifilament yarn fiber preferably drawn from a single spinnerette containing a plurality of filaments.

Figure 2:
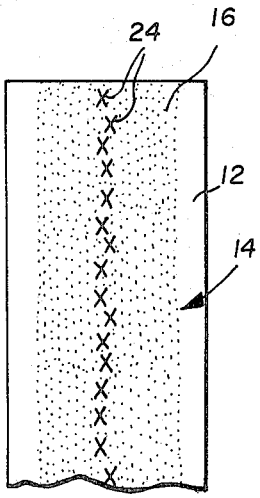
FIG. 2 is a top plan view of the weather strip of FIG. 1 in an unloaded condition.
Figure 4:
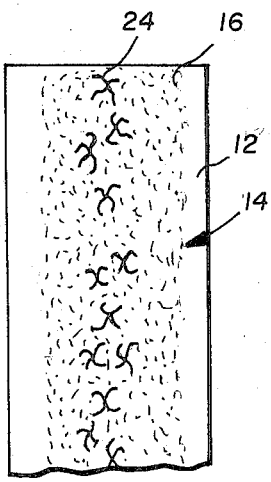
FIG. 4 is a top plan view similar to FIG. 2 of the weather strip when subjected to a load.
Figure 6:
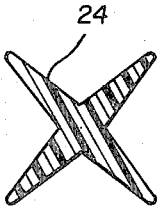
FIGS. 6 and 7 are enlarged cross-sectional views of solid and hollow monofilament yarns, respectively.
Figure 7:
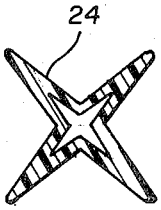

The inventive feature of this weather strip involves providing a barrier pile 22 formed from one or more rows of monofilament yarns 24 larger than yarns 16 and formed of a substantially identical non-circular solid or hollow cross-section as best seen in FIGS. 2, 6 and 7. Although a centrally located barrier pile 22 is shown in FIGS. 1–5, the row can be located adjacent one or the other side of a center row of yarn fibers 16. The monofilament yarns 24 are preferably of greater cross-sectional area than yarn fibers 16 and are secured to backing strip 12 in preferably closely packed relation by any of the same methods used to affix yarn fibers 16 to the strip. This eliminates the need for a separate fusing or welding operation and other possible processing steps previously required to secure a barrier fin or the like to the backing strip. The monofilament yarns 24 are of any suitable non-circular solid or hollow cross-section preferably shown as X-shaped, although other non-circular or irregular cross-sectional shapes such as L, Y, C, D or hexagonal, for example, can be used. With a barrier pile 22 formed from monofilament yarns 24, a pile weather strip is achieved having increased resistance to infiltration of foreign material such as air and moisture. It is believed that by closely packing the monofilament yarns 24 in nesting relation and relying on the infiltration of the smaller yarn fibers 16 therebetween, the spaces between the intermeshing monofilaments is reduced resulting in a reduction in the passage of air or moisture through pile 22. This sealing advantage is enhanced by the use of soft yarns, and is achieved without any reduction in other desirable performance characteristics of the pile such as crush, wear, ultra-violet stabilization and weathering. Also, since no barrier fin is needed in this weather strip and softer yarns can be used, a reduced break-away force or sliding resistance of a sliding member relative to the weather strip is achieved.

While preferred embodiments of the invention have been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A pile weather strip for sealing the space between relatively movable members, comprising:

a longitudinally extending backing strip;

a longitudinally extending first row of body fibers, each body fiber characterized by a first maximum cross-sectional dimension and having one end attached to said backing strip and its opposite free end projecting from said backing strip; and a second longitudinally extending row of substantially identical nestable monofilament barrier fibers adjacent said first row of body fibers, each monofilament barrier fiber having a non-circular cross-sectional shape characterized by at least one cross-sectional dimension greater than the maximum cross-sectional dimension of said body fibers and generally longitudinally aligned along said backing strip and having one end of said barrier fiber attached to said backing strip and its opposite free end projecting from said backing strip said row of barrier fibers operative to substantially reduce the infiltration of air and moisture thereacross.

2. A pile weather strip according to claim 1 wherein said non-circular monofilament yarn fiber is of solid cross-section.

3. A pile weather strip according to claim 1 wherein said non-circular monofilament yarn fiber is of hollow cross-section.

4. A pile weather strip according to claim 1 wherein each of said monofilament yarn fibers has a substantially X-shaped cross-section.

5. A pile weather strip according to claim 4 wherein said X-shaped cross-section is solid.

6. A pile weather strip according to claim 4 wherein said X-shaped cross-section is hollow.

7. A pile weather strip according to claim 4 wherein said body fiber is a multifilament yarn fiber.

8. The weatherstrip of claim 1 wherein said second longitudinally extending row of barrier fibers comprises a plurality of body fibers intermixed with said barrier fibers.

* * * * *